US005381683A

United States Patent [19]

Cowling

[11] Patent Number: 5,381,683

[45] Date of Patent: Jan. 17, 1995

[54] CAN ENDS

[75] Inventor: Gregory J. Cowling, Highworth, United Kingdom

[73] Assignee: CarnaudMetalBox plc, United Kingdom

[21] Appl. No.: 239,927

[22] Filed: May 9, 1994

Related U.S. Application Data

[63] Continuation of Ser. No. 897,112, Jun. 11, 1992, abandoned.

[30] Foreign Application Priority Data

Jun. 13, 1991 [GB] United Kingdom ..... 9112783

[51] Int. Cl.[6] ..... B21D 51/44

[52] U.S. Cl. ..... 72/329; 72/348

[58] Field of Search ..... 72/329, 336, 348

[56] References Cited

U.S. PATENT DOCUMENTS

| | | | |
|---|---|---|---|
| 3,537,291 | 11/1970 | Hawkins et al. . | |
| 3,685,338 | 8/1972 | Hoffman . | |
| 3,814,279 | 6/1974 | Rayzal . | |
| 4,587,826 | 5/1986 | Bulso, Jr. et al. . | |
| 5,024,077 | 6/1991 | Bulso, Jr. et al. | 72/348 |

FOREIGN PATENT DOCUMENTS

| | | |
|---|---|---|
| 0153115 | 2/1985 | European Pat. Off. . |
| 0348070 | 6/1989 | European Pat. Off. . |
| 2137293 | 3/1971 | France . |
| 2193140 | 2/1987 | United Kingdom . |
| 2196564 | 4/1987 | United Kingdom . |
| 2196891 | 6/1987 | United Kingdom . |
| 2128024 | 4/1989 | United Kingdom . |

*Primary Examiner*—Lowell A. Larson
*Attorney, Agent, or Firm*—Diller, Ramik & Wight

[57] ABSTRACT

A method of forming a can end having a seaming panel 30, a chuck wall 32, and a central panel 17; the central panel being connected to the chuck wall by an outer anti-peaking bead 27 and the can end having one or more flexible beads 24,25 located concentrically within the outer bead, the method comprises the steps of:

a) in a first stage, drawing a preliminary cup having a seaming panel, a chuck wall and a central panel, and forming the inner beads by pressing the central panel between upper and lower profiled tools 15,16; and b) in a second stage, clamping the seaming panel and the central panel and moving them towards one another to form the outer bead 27 by deformation of material from the chuck wall in an unconstrained rolling action.

8 Claims, 6 Drawing Sheets

CAN ENDS

This application is a continuation of application Ser. No. 07/897,112, filed Jun. 11, 1992, now abandoned.

The invention relates to can ends and to a method and apparatus for their manufacture. In particular the invention relates to can ends for food. Such can ends are normally made of steel and are formed with concentric beads which permit some flexing of the can end when seamed to a can body to accommodate changes of pressure within the can body during and after processing of a food product therein.

Conventional can ends of this kind are provided with e.g. three concentric beads arranged near the seaming panel of the can end, leaving a generally flat or slightly dished central panel. Such can ends are made by blanking a circular disc of steel, drawing to generate a shallow cup with a seaming panel, and formation of the beads by a pressing action between male and female profiled tools which penetrate one another. In conventional tooling the lower bead tool is static throughout the press stroke and the upper bead tool carries the material downward, penetrating the lower bead tool at the bottom of its stroke and setting a bead profile in the material.

Apparatus employing conventional tooling is shown in FIG. 1. With this apparatus, all the beads are drawn simultaneously over the tool bead profiles. This produces considerable radial stresses in the material. Measurements show that drawing the material over each bead profile, at the same time, results in significant amounts of thinning. The thinning that occurs on a typical profile is shown in FIG. 2.

In the design and production of can ends, constant efforts are made to reduce the starting metal thickness. A reduction of one thousandth of an inch can produce phenomenal savings over the course of a production year, due to the tremendous quantities of these pieces produced.

The starting material used to make food can ends for the Petfood industry is commonly single reduced (SR) TFS in thickness of about 0.21 mm. When the seamed food can is processed, the can end must withstand a pressure of 2–3 bar (30–45 psi) without failing. Failure is characterised by the outer bead buckling or locally reversing, which relieves the in-can pressure.

To make a can end with a lower starting metal thickness, some means of strengthening the end is necessary. One way of strengthening the end profile is to deepen or tighten the outer, "anti-peaking" bead. With conventional tooling, this can only be achieved by increasing the penetration of the centre panel bead tools. Unfortunately, this increases the amount of drawing as each bead is formed, which results in greater thinning. This weakens the end profile and seriously increases disruption of the protective lacquer. The net result is an unacceptable end.

SUMMARY OF THE INVENTION

The invention overcomes the disadvantages of the prior art by forming the beads in two stages; the inner beads being formed in a pressing stage as previously, and the outer bead being formed subsequently in a reforming stage. In the reforming stage the centre panel and the seaming panel are both clamped by the tooling and are moved towards one another so that the outer (anti-peaking) bead is formed in an unconstrained rolling action rather than by drawing and consequently is not weakened through thinning and benefits from superior lacquer integrity.

Accordingly the invention provides a method of forming a can end having a seaming panel, a chuck wall, and a central panel; the central panel being connected to the chuck wall by an outer anti-peaking bead and the can end having one or more flexible beads located concentrically within the outer bead, the method comprising the steps of:

a) in a first stage, drawing a preliminary cup having a seaming panel, a chuck wall and a central panel, and forming the inner beads by pressing the central panel between upper and lower profiled tools; and b) in a second stage, clamping the seaming panel and the central panel and moving them towards one another to form the outer bead by deformation of material from the chuck wall in an unconstrained rolling action.

Formation of anti-peaking beads in an unconstrained rolling action is in itself a well understood operation and is described for example in EP-A-0153115.

The invention also provides apparatus for forming a reinforced pressure resistant can end from sheet metal, said apparatus comprising a cutting ring, a cutting punch shell enterable into the cutting ring to blank out a disc of metal therebetween, an annular draw ring axially aligned with said cutting punch shell to support a peripheral margin of the disc held against it by said cutting punch shell, a die centre ring arranged coaxially and slidably within the draw ring and having an end face profiled to define a surface of a seaming panel of the can end, an ejector pressure ring arranged coaxially and slidably within the cutting punch shell and axially aligned with the die centre ring so that, when in use, peripheral material of the blank is restrained between the die centre ring and the ejector pressure ring, a draw punch centre arranged coaxially and slidably within the ejector pressure ring and a reform pad arranged coaxially and slidably within the die centre ring to engage the central panel of the blank opposite the draw punch centre; wherein the draw punch centre and the reform pad are provided with male and female profiles on their opposed faces for forming one or more concentric beads in the central panel of the can end and wherein the reform pad is formed with an annular recess surrounding its end facing the draw punch centre.

The invention also provides a can end comprising a seaming panel, a chuck wall, and a central panel; wherein the central panel is formed with one or more concentric flexible beads which have been formed by pressing, and is connected to the chuck wall by an anti-peaking bead which has been formed in an unconstrained rolling action. Preferably, the central panel is surrounded by an outwardly concave reinforcing bead which joins the central panel to the chuck wall which flares outwardly to a peripheral seaming panel in which the central panel comprises a substantially flat central panel portion surrounded by a plurality of concentric outwardly convex beads. Each of the convex beads has a radius of curvature greater than the radius of curvature of the convex reinforcing bead. Advantageously, the reinforcing bead is deeper than any of the concentric convex beads.

The metal thickness of the can end is typically less than 0.21 mm, preferably 0.16 mm.

The new technology produces a much tighter, deeper anti-peaking bead, without the thinning associated with the current end-making technology and without disruption of the protective lacquer. This enhances the buckling resistance by just enough to offset the loss in performance due to gauge reduction.

An embodiment of the present invention is described below with reference to the accompanying drawings in which:

DESCRIPTION OF THE PREFERRED EMBODIMENTS

Figure 1:
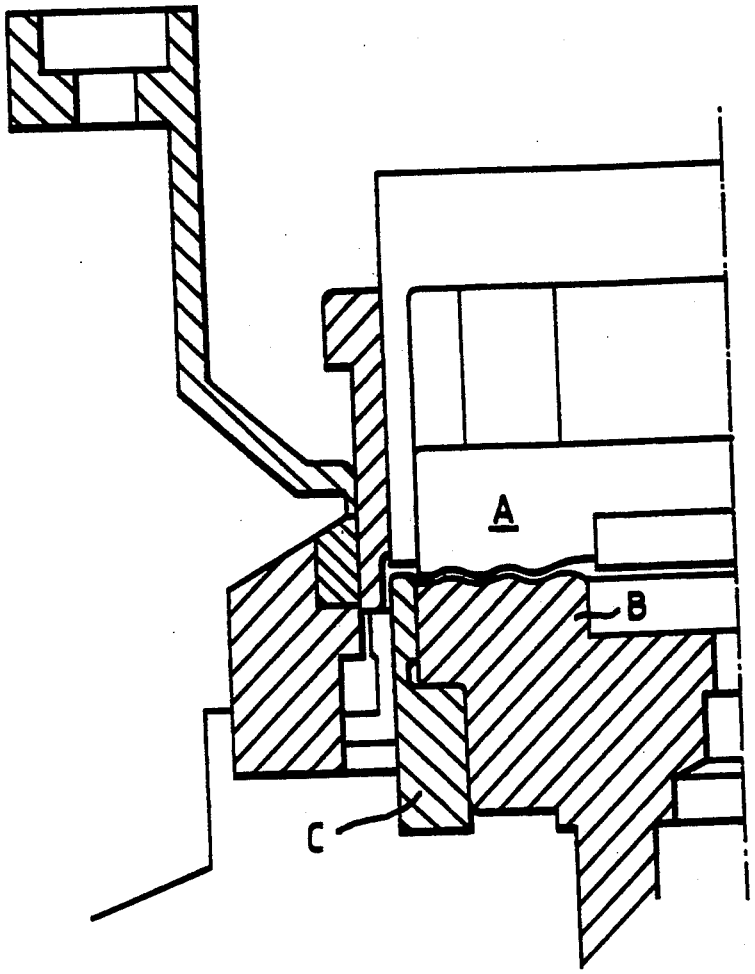
FIG. 1 is a section through part of a conventional can end forming apparatus.

The conventional apparatus shown in FIG. 1 is well known and will not be described in detail. As can be seen, the apparatus has a punch centre A and a pad B having mating male and female profiles which form three concentric beads in a can end by pressing. The outer bead is slightly tighter than the two inner beads and forms an anti-peaking bead. It should also be noted that pad B is stationary and in particular, it cannot move downwardly relative to the die centre ring C.

Figure 2:
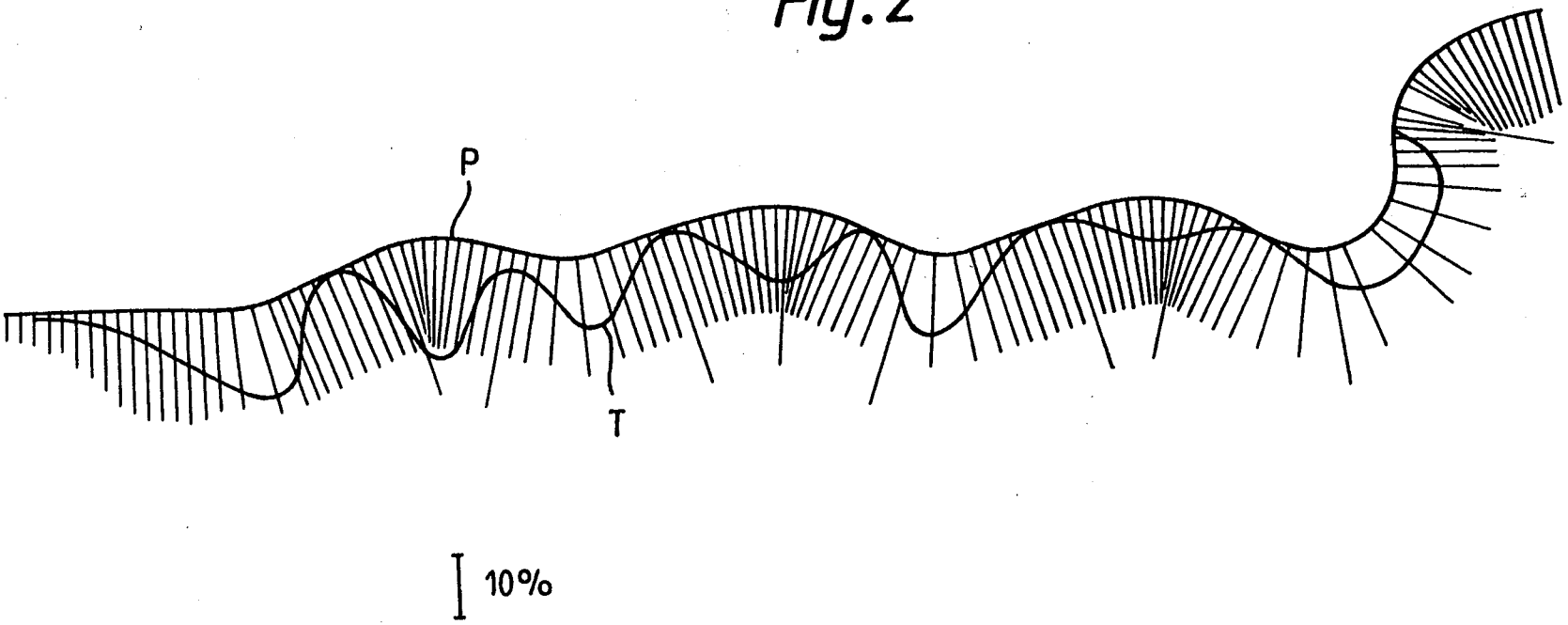
FIG. 2 is a graphical representation of a typical thinning profile of a can end formed on apparatus as shown in FIG. 1.

FIG. 2 shows that can ends formed on the apparatus of FIG. 1 are subject to a substantial amount of thinning in the regions where material has been drawn to form the beads. Curve P represents the can end profile, and curve T represents the thinning of the material along the profile. Where the curves meet there is no thinning. The spacing between the curves represents the degree of thinning.

Figure 3:
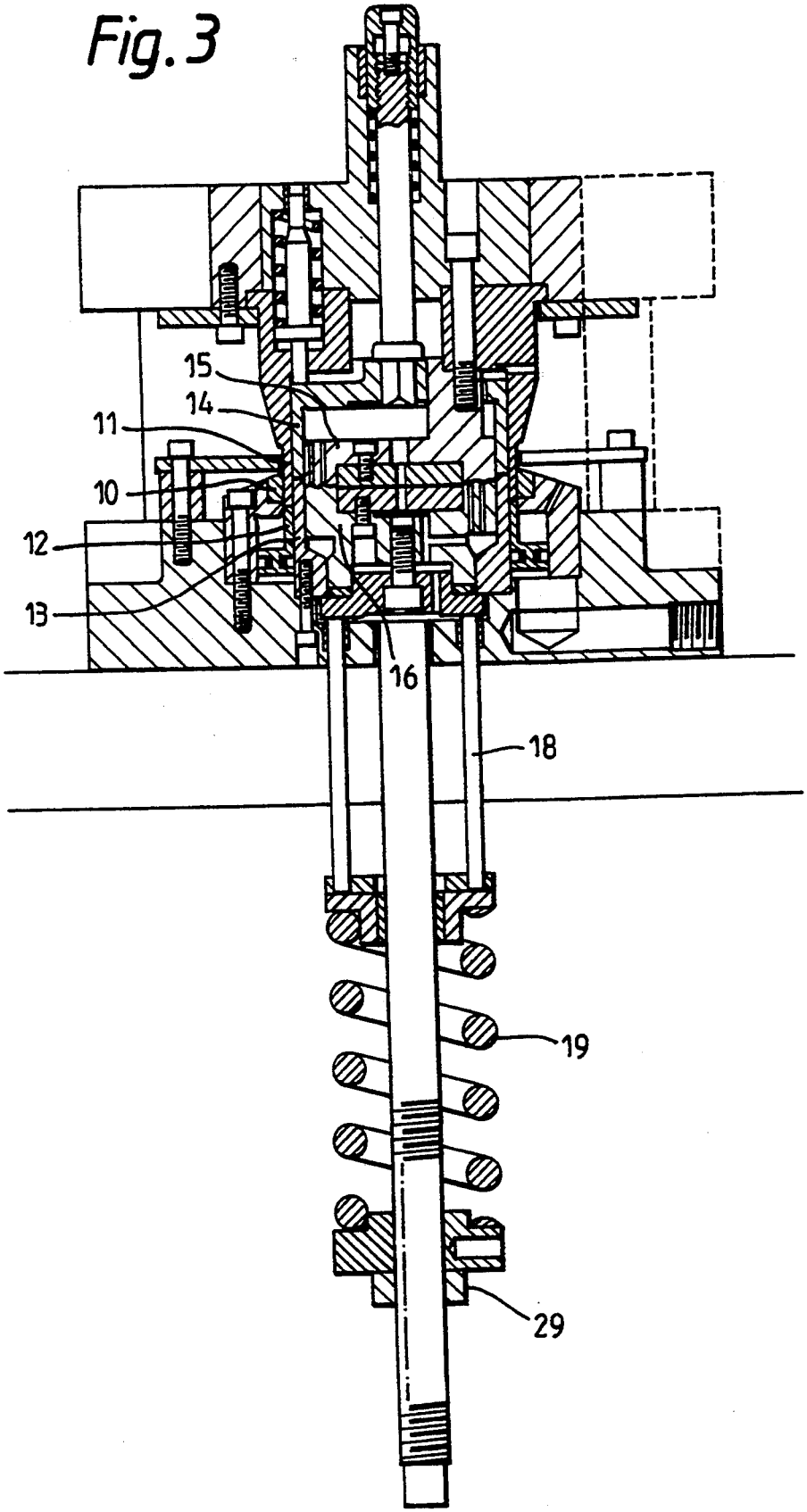
FIG. 3 shows apparatus in accordance with the present invention.

FIG. 3 is an overall view of apparatus and is largely conventional so is not described in detail. The apparatus includes a cutting ring 10 and a cutting punch shell 11 enterable into the cutting ring 10 to blank out a disc of metal therebetween. An annular draw ring 12, supported on an air cushion, is axially aligned with the cutting punch shell to support a peripheral margin of the disc held against it by the cutting punch shell. A die centre ring 13 is arranged coaxially and slidably within the draw ring and has an end face profiled to define the lower surface of the seaming panel of the can end. An ejector pressure ring 14 is arranged coaxially and slidably within the cutting punch shell and is axially aligned with the die centre ring so that when in use, peripheral material of the blank is restrained between the die centre ring and the ejector pressure ring. A draw punch centre 15 which is rigid with the cutting punch shell 11 is arranged coaxially and slidably within the ejector pressure ring and a reform pad 16 is arranged coaxially and slidably within the die centre ring 13 to engage the central panel of the blank opposite the draw punch centre. The reform pad is resiliently mounted on an array of pressure pins 18 supported on a buffer spring 19 the compression of which may be adjusted by means of a nut 29. The spring 19 may be replaced by a pneumatic or hydraulic spring. Details of the profiles of the draw punch centre and the reform pad and of the operation of the apparatus are described below with reference to FIGS. 4–8.

Figure 4:
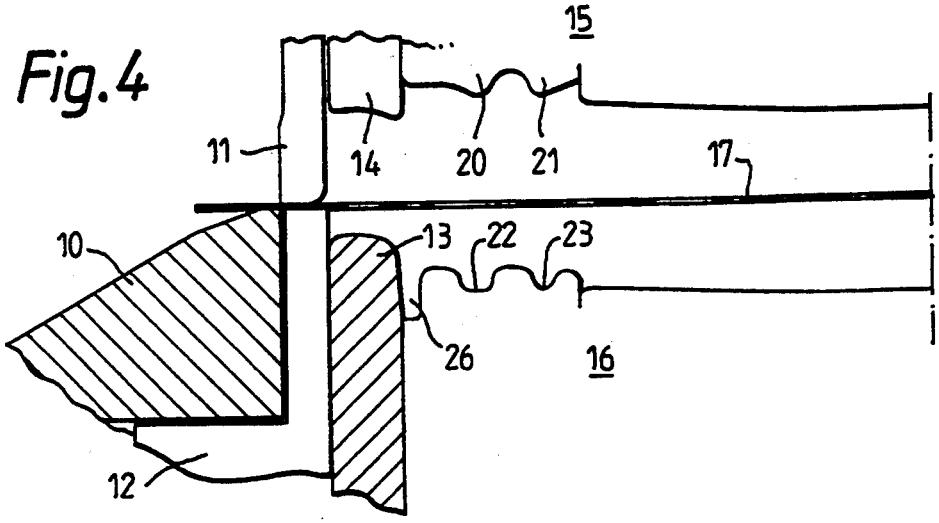
FIGS. 4–8 are sequential views of part of the apparatus showing the formation of a can end.
Figure 5:
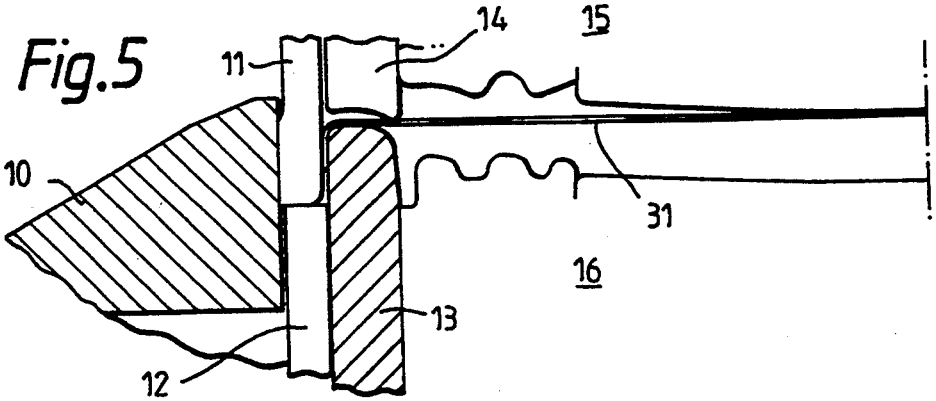
Figure 6:
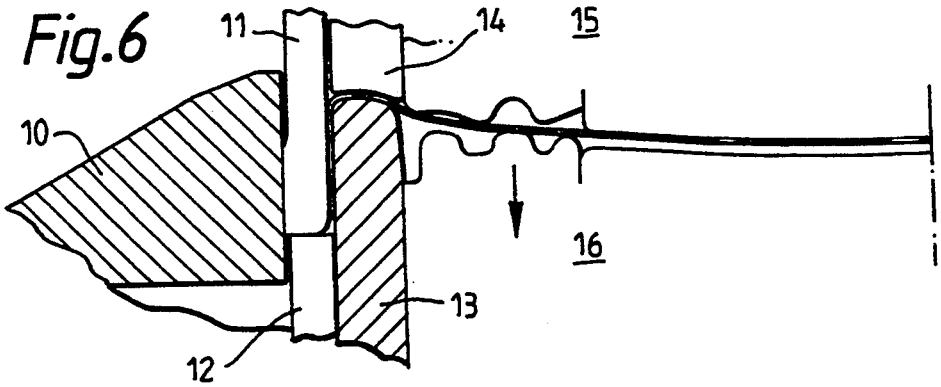
Figure 7:
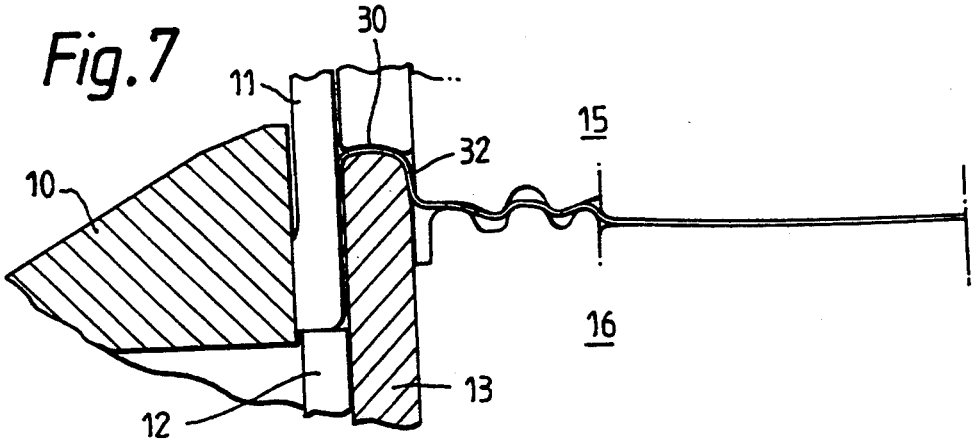

FIG. 4 shows an early point in the cycle of operation of the apparatus. At this point the draw punch centre 15, the ejector pressure ring 14, and the cutting punch shell 11 have moved downwards from their fully raised position to the point where the blank is about to be cut by the cutting ring 10 and the cutting punch shell 11. The reform pad is now in its fully raised position as is the draw ring 12. The cutting ring 10 and the die centre ring 13 are stationary throughout the cycle. After cutting out of the blank, the leading face of the cutting punch shell presses the periphery of the blanked disc 17 against the draw ring. As the upper tooling carried on the press cross-head moves further down, material is drawn into the space between the cutting punch shell and the die centre ring to produce a reversed-cup as shown in FIG. 5. As the upper tooling continues to move downwardly the ejector pressure ring 14 is stopped by the die centre ring and resiliently presses the material of the blank against it defining the shape of the seaming panel 30. The punch centre 15 continues to move downwardly and contacts the central panel 31 of the blank. Further downward movement of the punch centre draws material between the die centre ring 13 and the ejector pressure ring 14 and pushes the central panel of the blank into engagement with the reform pad which moves downwards against the resistance of its resilient mounting. During downward movement of the reform pad the draw punch centre material is progressively drawn over the two inner bead profiles and at the same time the chuck wall 32 is formed. The downward travel of the reform pad is limited within the tool to set the beads at the bottom of the stroke. That is, the inner beads are completely formed when the press reaches the bottom of its stroke as in FIG. 7.

As shown the punch centre profile has two raised annular peaks 20, 21 which co-operate with troughs 22, 23 in the reform pad to define the profile of two inner beads 24 and 25 in the radially outer part of the central panel 31.

As the press begins to rise again, the seaming panel 30 is clamped between the ejector pressure ring 14 and the die centre ring 13, and the central panel 31 is clamped between the punch centre 15 and reform pad 16. Material at the bottom of the chuck wall 31 is thus deformed in an unconstrained rolling action into the annular recess 26 which surrounds the end of the reform pad facing the punch centre.

Figure 8:
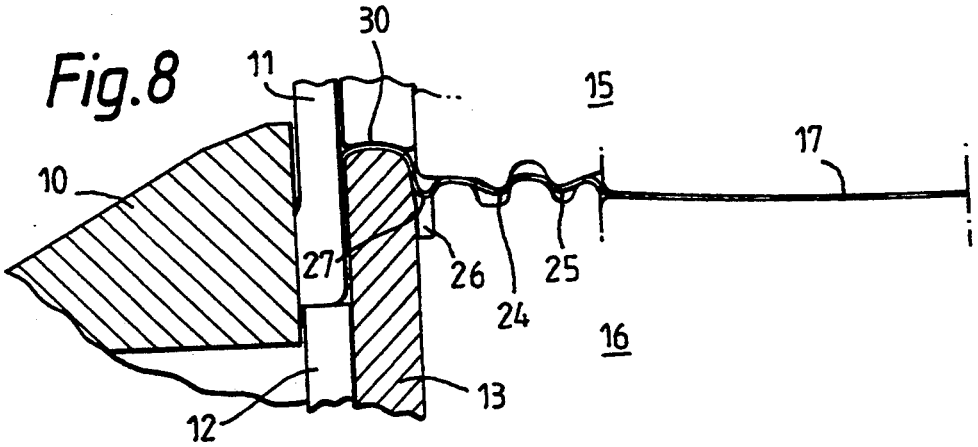

At the end of the upward movement of the reform pad, a tight anti-peaking bead 27 has been formed—FIG. 8. The upper tooling is then further raised and the can end ejected from the press.

Figure 9:
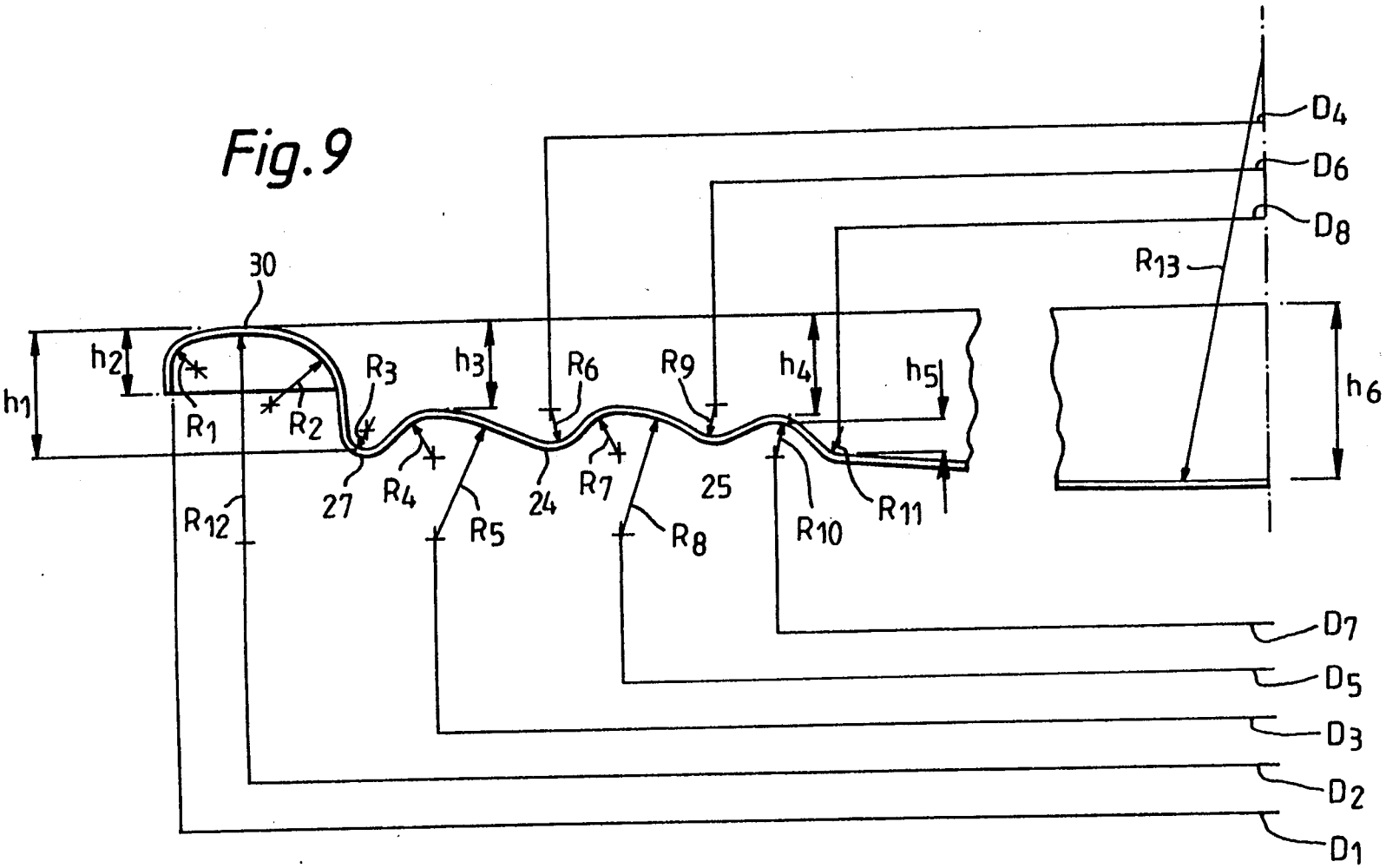
FIG. 9 shows part of the profile of a can end in accordance with the invention.

FIG. 9 shows an example of the profile of a can end formed in accordance with the invention. Dimensions of radii $R_1$–$R_{13}$, heights $h_1$–$h_6$ and diameters $D_1$–$D_8$ are given below.

| | |
|---|---|
| $R_1$=0.71mm | $h_1$=3.3mm |
| $R_2$=1.8mm | $h_2$=1.65mm |
| $R_3$=.51mm | $h_3$=2.29mm |
| $R_4$=1.1mm | $h_4$=2.67mm |
| $R_5$=3.2mm | $h_5$=.5mm |
| $R_6$=.89mm | $h_6$=4.58mm |
| $R_7$=1.1mm | |
| $R_8$=3.2mm | $D_1$=82mm |
| $R_9$=.89mm | $D_2$=78mm |
| $R_{10}$=.89mm | $D_3$=68mm |
| $R_{11}$=.51mm | $D_4$=62mm |
| $R_{12}$=5.4mm | $D_5$=58mm |
| $R_{13}$=30mm | $D_6$=53mm |
| | $D_7$=50mm |
| | $D_8$=47mm |

In a preferred can end the height $h_1$ is between 2.54 and 3.81 mm, radius $R_3$ is between 0.38 mm and 0.89 mm, and the difference between $h_1$ and $h_3$ is between 0.51 mm and 1.8 mm.

Preferably, at least one of the concentric convex beads has a compound curvature arising from an outer radius portion ($R_4$, $R_7$) smaller than the corresponding inner radius portion ($R_5$, $R_8$).

I claim:

1. A method of forming a can end having a seaming panel, a chuck wall, and a central panel; the central panel being connected to the chuck wall by an outer anti-peaking bead and the can end having at least one flexible bead located concentrically within the outer bead, the method comprising the steps of:

a) first drawing a preliminary cup having a seaming panel, a chuck wall and a central panel, and forming the at least one flexible bead by pressing the central panel between upper and lower profiled tools; and b) after the drawing operation, clamping the seaming panel between a pressure ring and a die face, clamping the central panel between the upper and lower profile tools and moving the clamped seaming panel and the clamped central panel axially toward one another by axially moving the profile tools relative to the pressure ring and die face to form the outer bead by deformation of material from the chuck wall in an unconstrained rolling action without disturbing the at least one flexible bead.

2. The method as defined in claim 1 wherein during the performance of the drawing operation a plurality of flexible beads are formed by pressing the central panel between the upper and lower profiled tools.

3. The method as defined in claim 2 wherein each flexible bead is formed with a radius of curvature smaller than the next bead periphery outboard thereof.

4. Apparatus for forming a reinforced pressure resistant can end from sheet metal, said apparatus comprising a cutting ring, a cutting punch shell enterable into the cutting ring to blank out a disc of metal therebetween, an annular draw ring axially aligned with said cutting punch shell to support a peripheral margin of the disc held against it by said cutting punch shell, a die centre ring arranged coaxially and slidably within the annular draw ring and having an end face profiled to define a surface of a seaming panel of the can end, an ejector pressure ring arranged coaxially and slidably within the cutting punch shell and axially aligned with the die centre ring so that, when in use, peripheral material of the blank is restrained between the die centre ring and the ejector pressure ring, a draw punch centre arranged coaxially and slidably within the ejector pressure ring and a reform pad arranged coaxially and slidably within the die centre ring to engage the central panel of the blank opposite the draw punch centre; the draw punch centre and the reform pad are provided with cooperative male and female profile means on their opposed faces for forming at least one bead in the central panel of the can end upon movement of said draw punch centre toward said reform pad and subsequent joint movement of said draw punch centre and reform pad in a first direction, and the reform pad is formed with annular recess means surrounding its end facing the draw punch centre for forming another bead peripherally outboard of the at least one bead upon subsequent joint movement of the draw punch centre and reforming pad in a second direction opposite to said first direction, during which joint movement the male and female profile means cooperate to clamp the beaded central panel therebetween and the ejector pressure ring and die center ring cooperate to clamp the seaming panel therebetween, resulting in the unconstrained rolling of chuck wall material into said annular recess means without disturbing the at least one flexible bead.

5. Apparatus according to claim 4 in which the reform pad is resiliently mounted for limited axial movement under the influence of the draw punch centre.

6. The apparatus as defined in claim 4 wherein said cooperative male and female profile means form a plurality of concentric beads in the central panel of the can end upon the movement of the draw punch centre and the reform pad in said first direction.

7. The apparatus as defined in claim 6 wherein said cooperative male and female profile means form each flexible bead with a radius of curvature smaller than the next bead peripherally outboard thereof.

8. A method of forming a can end having a seaming panel, a chuck wall which flares outwardly to the seaming panel, a chuck wall which flares outwardly to the seaming panel, and a central panel; the central panel being connected to the chuck wall by an outer anti-peaking bead and the cam end having at least one flexible bead located concentrically within the outer bead, the method comprising the steps of:

a) first drawing a preliminary cup having a seaming panel, a chuck wall and a central panel by drawing a sheet metal blank between a die and a punch having at least one raised annular peak on its end wall so that as the punch enters the die the blank is progressively drawn over the peak to start forming of the at least one flexible bead at the same time as the chuck wall is formed and completed by closure of the punch on a reform pad; and b) after the drawing operation, clamping the seaming panel between a pressure ring and a die face, clamping the central panel between the punch and the reform pad and moving the seaming panel and central panel axially relative to one another to form the outer bead by deformation of material from the chuck wall in an unconstrained rolling action without disturbing the at least one flexible bead.

* * * * *